US008109506B2

(12) United States Patent
Prabhat et al.

(10) Patent No.: US 8,109,506 B2
(45) Date of Patent: Feb. 7, 2012

(54) SHEET OBSERVER WITH A LIMITED NUMBER OF SHEET SENSORS

(75) Inventors: Saurabh Prabhat, Webster, NY (US); Martin Krucinski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 147 days.

(21) Appl. No.: 12/474,477

(22) Filed: May 29, 2009

(65) Prior Publication Data

US 2010/0301547 A1 Dec. 2, 2010

(51) Int. Cl.
*B65H 7/02* (2006.01)

(52) U.S. Cl. ..... 271/227

(58) Field of Classification Search ..... 271/227, 271/228, 265.02

See application file for complete search history.

(56) References Cited

U.S. PATENT DOCUMENTS

| | | | | |
|---|---|---|---|---|
| 5,697,609 | A * | 12/1997 | Williams et al. | 271/228 |
| 6,137,989 | A | 10/2000 | Quesnel | |
| 6,373,042 | B1 | 4/2002 | Kretschmann et al. | |
| 6,511,239 | B1 | 1/2003 | Kretschmann et al. | |
| 6,701,837 | B2 | 3/2004 | Ohba et al. | |
| 6,836,627 | B2 | 12/2004 | Kretschmann et al. | |
| 6,920,307 | B2 | 7/2005 | Howe | |
| 6,920,308 | B2 | 7/2005 | Demchock et al. | |
| 6,988,725 | B2 | 1/2006 | Rapkin | |
| 7,127,992 | B2 | 10/2006 | Damm et al. | |
| 7,158,751 | B2 | 1/2007 | Howe | |
| 7,222,848 | B2 | 5/2007 | Elliott et al. | |
| 7,277,669 | B2 | 10/2007 | Howe | |
| 7,295,223 | B2 | 11/2007 | Jung | |
| 7,333,122 | B2 | 2/2008 | Park et al. | |
| 7,440,709 | B2 | 10/2008 | Mima et al. | |
| 2007/0048053 | A1 * | 3/2007 | De Jong et al. | 399/394 |

OTHER PUBLICATIONS

U.S. Appl. No. 12/371,110, filed Feb. 13, 2009, entitled Substrate Media Registration and De-Skew, Apparatus, Method and System.
U.S. Appl. No. 12/364,675, filed Feb. 3, 2009, entitled Modular Color Xerographic Printing Architecture.
U.S. Appl. No. 12/262,803, filed Oct. 31, 2008, entitled Method of and System for Module to Module Skew Alignment.
U.S. Appl. No. 12/430,677, filed Apr. 27, 2009, entitled Dynamic Image Registration Apparatus and Method.
U.S. Appl. No. 12/415,321, filed Mar. 31, 2009, entitled Transfer Belt Lateral Position Control Apparatus and Method.

* cited by examiner

*Primary Examiner* — Michael McCullough
(74) *Attorney, Agent, or Firm* — Hoffman & Baron, LLP

(57) ABSTRACT

A method and system for determining sheet position and orientation of a sheet as the sheet moves along a feed path is provided herein. The method includes moving the sheet along the feed path and past at least one point sensor to measure a first position of the sheet relative to a first reference axis coinciding with the process direction of the feed path. Next, the method provides for moving the sheet along the feed path and past at least one linear array sensor to measure a second position of the sheet relative to a second reference axis disposed perpendicular to the first reference axis and an angular orientation of the sheet in the reference plane relative to a third reference axis perpendicular to the reference plane. After that, a sheet velocity is determined. Then, one or more estimated sheet positions along the feed path are determined.

5 Claims, 5 Drawing Sheets

SHEET OBSERVER WITH A LIMITED NUMBER OF SHEET SENSORS

INCORPORATION BY REFERENCE

The following US Patent Application is incorporated in its entirety for the teachings therein: U.S. patent and Trademark Office application Ser. No. 12/364,675, filed Feb. 3, 2009, entitled MODULAR COLOR XEROGRAPHIC PRINTING ARCHITECTURE.

TECHNICAL FIELD

This disclosure generally relates to sheet observer for a printmaking device. It more particularly, relates to a sheet observer with a limited number of sheet sensors and registration sensors that can accurately estimate sheet position and orientation at all times.

BACKGROUND

In a printmaking device, sheet registration sensors are required to know the position and orientation of the sheet at various points in time, such as before the registration starts to know the initial errors to correct, after the registration to check registration errors or continuously throughout registration to do closed loop registration. It would be ideal to have sensors everywhere to know the sheet position and orientation at all times. But having a large number of sensors is not practical because of cost and space constraints in a printmaking device.

Currently, a limited number of sensors are used to register the sheet and check performance. These sensors are typically tailored to a given model or series of a printmaking device. When determining the sheet registration, center of mass information and other measurement information is initially based upon direct input (e.g., selecting A4, or 8½×14 inch sheet) or indirectly by adjustment of path guides or by sheet-size detectors. Thereafter, the position and orientation of a sheet is measured at various points in time and input into a control device, typically a computer processor that regulates the process elements of the feed path and informs the image controller.

Once sufficient information is obtained, the sheet registration is checked for registration errors periodically, or continuously in a closed-loop registration system. The problem with the current methods and systems using the limited number of sensors is that the information relating to the sheet position and the sheet orientation is not always available when needed. Therefore, it would be advantageous to provide a sheet observer system and method that utilizes mathematical models to accurately estimate the position and orientation of a sheet at all times based on limited sheet sensor readings to provide better registration performance.

SUMMARY

According to aspects illustrated herein, there is provided a method for determining sheet position and orientation of a sheet as the sheet moves along a feed path. The method includes moving the sheet along the feed path and past at least one point sensor to measure a first position of the sheet relative to a first reference axis coinciding with the process direction of the feed path. The first position being determined within a reference plane through which the first reference axis passes. Next, the method provides for moving the sheet along the feed path and past at least one linear array sensor to measure a second position of the sheet relative to a second reference axis disposed perpendicular to the first reference axis and an angular orientation of the sheet in the reference plane relative to a third reference axis perpendicular to the reference plane. The second position of the sheet being determined as a distance of a side edge of the sheet from the first reference axis and the angular orientation of the sheet being determined about the third reference axis disposed perpendicular to the reference plane. After that, the sheet velocity is determined by one or more of the methods including: user input, solving equations related to the speed of the motors that drive the nip and in turn drive the paper, and measuring the sheet velocity directly using one or more velocity sensors. Then, one or more estimated sheet positions along the feed path are determined using the sheet velocity, the first position of the sheet, the second position of the sheet, and the angular orientation of the sheet.

According to other aspects illustrated herein, there is provided a method for determining sheet position and orientation of a sheet as the sheet moves along a feed path. The method includes moving the sheet along the feed path and past at least one point sensor to measure a first position of the sheet relative to a first reference axis coinciding with the process direction of the feed path. The first position being determined within a reference plane through which the first reference axis passes. Next, the method provides for moving the sheet along the feed path and past at least one linear array sensor to measure a second position of the sheet relative to a second reference axis disposed perpendicular to the first reference axis and an angular orientation of the sheet in the reference plane relative to a third reference axis perpendicular to the reference plane. The second position of the sheet being determined as a distance of a side edge of the sheet from the first reference axis and the angular orientation of the sheet being determined about the third reference axis disposed perpendicular to the reference plane. After that, the sheet velocity is determined by one or more of the methods including: user input, solving equations related to the speed of the motors that drive the nip and in turn drive the paper, and measuring the sheet velocity directly using one or more velocity sensors. Then, as the sheet moves along the feed path and past at least one monitoring sensor, with the monitoring sensor detecting one or more reference points. The one or more reference points being one or more of the following selected from the group consisting of a lead edge, a trail edge, a side edge, and a corner position of one or more corners of the sheet. Thereafter, the method calculates one or more estimated sheet positions of the sheet coinciding with the portion of the sheet at the monitoring sensor based on the sheet velocity, the first position of the sheet, the second position of the sheet, and the angular orientation of the sheet. Finally, each of the one or more reference points collected by the monitoring sensor is compared to the one or more estimated sheet positions corresponding to the one or more reference points and the one or more estimated sheet positions are updated based on the comparison.

According to other aspects illustrated herein, there is provided a system for determining sheet position and orientation of a sheet. The system includes a feed path for transporting the sheet, a controller including a computer processor, at least one point sensor, at least one linear array sensor, and at least one monitoring sensor. The at least one point sensor measures a first position of the sheet relative to a first reference axis coinciding with a process direction of the feed path. The first position being determined within a reference plane through which the first reference axis passes. The at least one linear array sensor measures a second position of the sheet relative to a second reference axis disposed perpendicular to the first reference axis and an angular orientation of the sheet in the reference plane relative to a third reference axis perpendicular to the reference plane. The second position of the sheet being determined as a distance of a side edge of the sheet from the first reference axis, and the angular orientation of the sheet being determined about a third reference axis disposed perpendicular to the first reference plane. The at least one monitoring sensor detects one or more reference points. The one or more reference points being one or more of the following selected from the group consisting of a lead edge, a trail edge, a side edge, and a corner position of one or more corners of the sheet. The controller determines a sheet velocity. After that, the controller calculates one or more estimated sheet positions of the sheet coinciding with the portion of the sheet at the monitoring sensor based on the sheet velocity, the first position of the sheet, the second position of the sheet, and the angular orientation of the sheet. Then, each of the one or more reference points collected by the monitoring sensor is compared to the one or more estimated sheet positions corresponding to the one or more reference points and the one or more estimated sheet positions are updated based on the comparison.

Additional features and advantages will be readily apparent from the following detailed description, the accompanying drawings and the claims. It is to be understood, however, that the drawings are designed as an illustration only and not as a definition of the limits of the disclosure.

BRIEF DESCRIPTION OF THE DRAWINGS

Like reference symbols in the various drawings indicate like elements.

DETAILED DESCRIPTION

Figure 1:
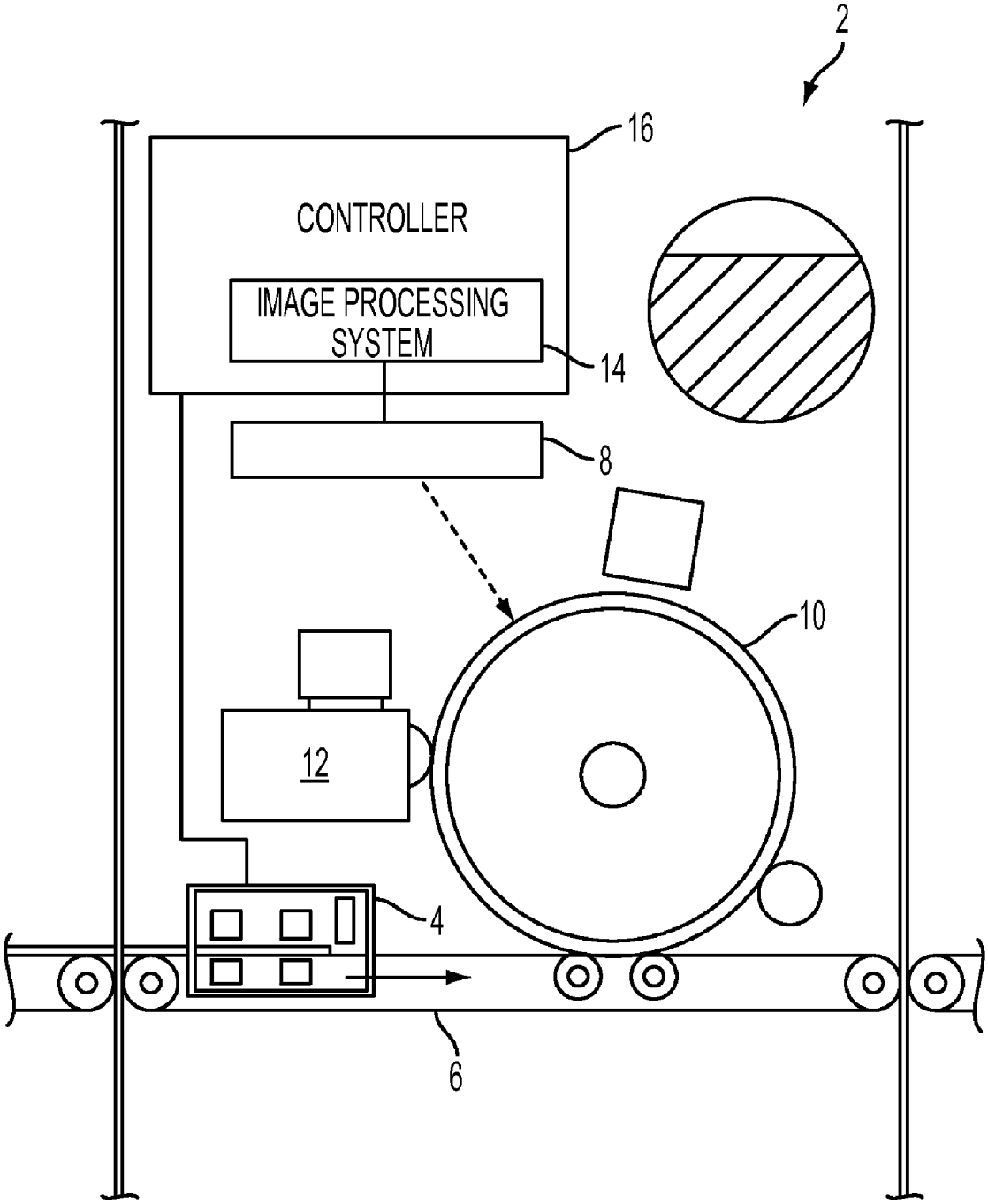
FIG. 1 shows an elevational view of a module for a xerographic printer including a sheet sensing system.

The method and system provided herein use a limited number of sensors and mathematical formulas to determine a position and an orientation of a sheet of paper. Furthermore, the method and system provided herein enables the printmaking device to make adjustments to a sheet prior to printing, avoiding printing errors.

As used herein, the phrase "printmaking device" encompasses any apparatus, such as a digital copier, a bookmaking machine, a facsimile machine, and a multi-function machine, which performs a printing outputting function for any purpose. Examples of marking technologies include xerographic, inkjet, and offset marking.

As used herein, the phrase "sheet observer system" refers to components of printmaking devices that determines and predicts a lateral and a process position of a sheet in a feed path, and ascertains an angular orientation of the sheet. The sheet observer system may be configured to cooperate with the printmaking device to adjust the position and angular orientation of the sheet based on the predicted position and orientation of the sheet prior to marking.

As used herein, the phrase "sheet" encompasses, for example, one or more of a usually flimsy physical sheet of paper, heavy media paper, coated paper, transparency, parchment, film, fabric, plastic, or other suitable physical print media substrate on which information can be reproduced.

As used herein, the phrase "feed path" encompasses any apparatus for separating and/or conveying one or more sheets into a substrate conveyance path inside a printmaking device.

As used herein, the phrase "lead edge" refers to the edge of a sheet that first advances along the feed path.

As used herein, the phrase "trail edge" refers to the edge of a sheet that advances last along the feed path.

As used herein, the term "angular orientation" refers to an angular error in the positioning of a sheet along the feed path. The terms "skew" and "angular orientation" are used herein interchangeably.

As used herein, the term "process" refers to a process of printing or reproducing information on substrate media.

As used herein, the term "process direction" is a flow path the substrate media moves in during the process.

As used herein, the term "lateral direction" refers to a direction perpendicular to the process direction. Also referred to as "cross-process direction."

As used herein, "sensor" refers to a device that responds to a physical stimulus and transmits a resulting impulse for the measurement and/or operation of controls. Such sensors include those that use pressure, light, motion, heat, sound and magnetism. Also, each of such sensors as referred to herein can include one or more point sensors and/or array sensors for detecting and/or measuring characteristics of a substrate media, such as speed, orientation, process or cross-process position and even the size of the substrate media. Thus, reference herein to a "sensor" may include more than one sensor.

As used herein, the term "center of mass" or the abbreviation "CM" refers to the center of mass of a uniform rectangular plane, which is the geometric center of mass. In other words, the point in which the region will be perfectly balanced horizontally if suspended from that point.

As used herein, the phrase "top edge" refers to the edge of a sheet that is adjacent to the lead edge and the trail edge and is shown as the edge above and approximately parallel to the x axis in the figures. The top edge may also be generally referred to as a side edge.

As used herein, the term "bottom edge" refers to the edge of a sheet that is adjacent to the lead edge and the trail edge and is shown as the edge below and approximately parallel to the x axis in the figures. The bottom edge may also be generally referred to as a side edge.

As used herein, the phrase "linear array sensor" refers to multiple sensors stacked and located at a fixed reference to provide an array of values to determine the position of a sheet of paper.

As used herein, the phrase "point sensor" refers to a single sensor located at a fixed reference and used to identify a measurement.

As used herein the term "squareness" refers to the rectangularity of the sheet.

As used herein, the phrases "first reference axis," "reference plane," and "reference points" refer a non-changing alignment and configuration where the sensor collects information. The reference is a fixed reference when the sensor will only detect activity at one configured location. For example, a fixed reference may be a sensor at the edge of a paper tray that detects when paper leaves the tray.

FIG. 1 provides an exemplary module 2 of a printmaking device including a sheet observer system 4 for use with the method provided herein. The sheet observer system 4 is disposed to detect the position of a sheet being received in the module 2 and riding on a transport along a feed path 6. The sheet observer system 4 is configured to detect anomalies in the position of the sheet received on transport along the feed path 6 and output what can be called an "error signal" related to any anomaly. This error signal in turn can be used to influence an exposure device 8. As will be noted, the sheet observer system 4 will be looking at an edge or a particular small area on a sheet on transport along the feed path 6 slightly before the exposure device 8 is creating a corresponding portion of an electrostatic latent image on the photoreceptor 10, in such a way that an anomaly detected at a given moment by the sheet observer system 4 can be detected and compensated for shortly thereafter by the exposure device 8.

The exposure device 8 is attached to the image processing system 14 in a controller 16. The controller 16 may also include a computer processor to assist the controller 16 in calculating errors and determining the appropriate correction. Then, the imaging processing system 14 transmits the information relating to the appropriate corrections to the exposure device 8. Thus, after the latent image is developed at a development unit 12 and transferred to the print sheet at the transfer zone, the pre-existing printed image on the sheet and the corrected, newly-transferred image will "match," particularly in a color-separation registration sense.

Figure 2:
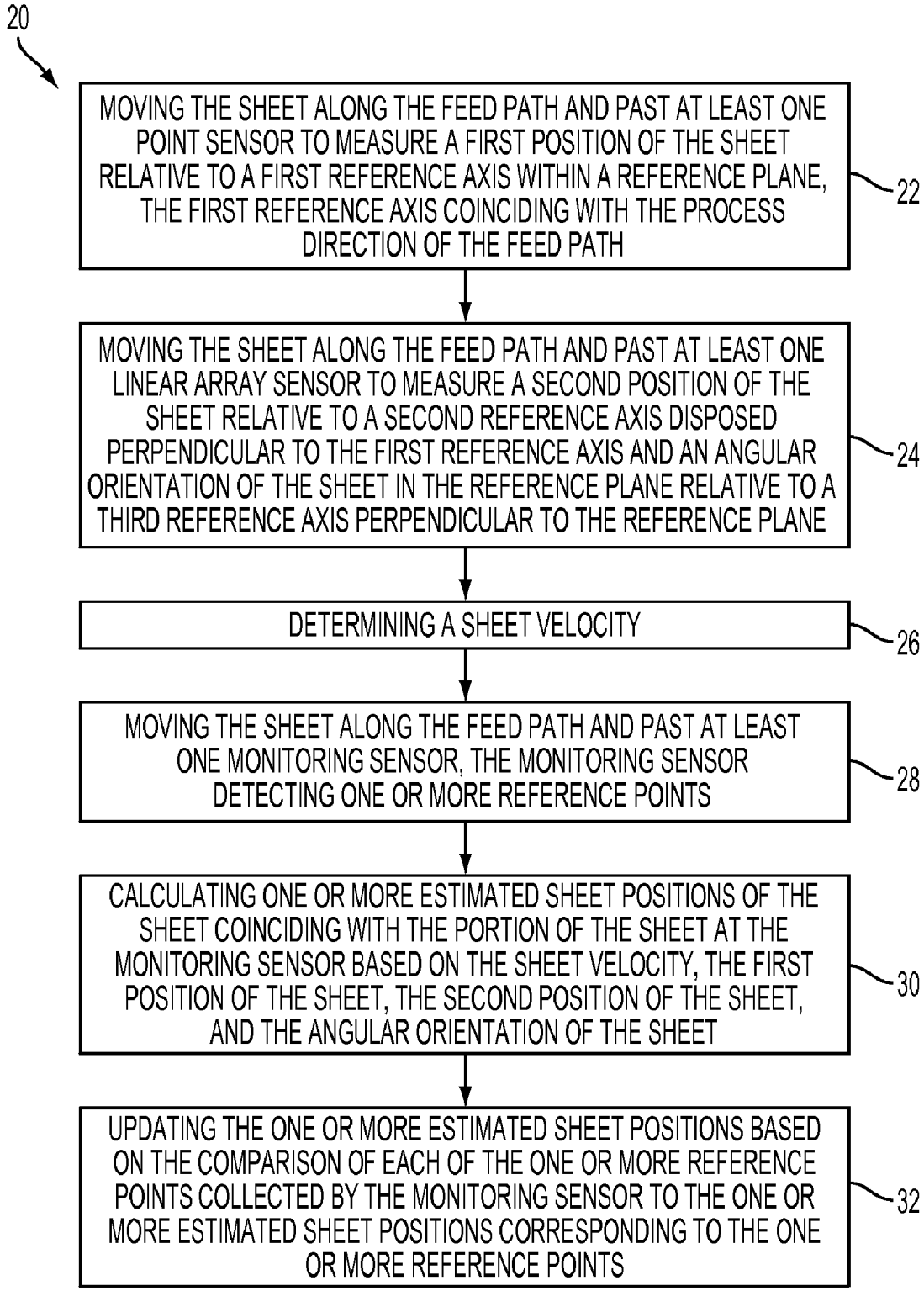
FIG. 2 illustrates a method for determining a complete sheet position and orientation of a sheet using a limited number of sensors.

Referring now to FIG. 2, a method 20 is provided for determining sheet position and orientation of a sheet as the sheet moves along a feed path 6. The method 20 includes step 22 of moving the sheet along the feed path 6 and past at least one point sensor to measure a first position of the sheet relative to a first reference axis coinciding with the process direction of the feed path 6. The first position being determined within a reference plane through which the first reference axis passes. In step 24, the sheet continues to move along the feed path 6 and past at least one linear array sensor to measure a second position of the sheet relative to a second reference axis disposed perpendicular to the first reference axis and an angular orientation of the sheet in the reference plane relative to a third reference axis perpendicular to the reference plane. The second position of the sheet being determined as a distance of a side edge of the sheet from the first reference axis and the angular orientation of the sheet being determined about the third reference axis disposed perpendicular to the reference plane.

Next, a sheet velocity is determined in step 26. The sheet velocity may be determined by one or more of the methods including: user input, solving equations related to the speed of the motors that drive the nip and in turn drive the paper, and measuring said sheet velocity directly using one or more velocity sensors. Then, in step 28, the sheet continues moving along the feed path 6 and past at least one monitoring sensor to detect one or more reference points. The one or more reference points being one or more of the following selected from the group consisting of a lead edge, a trail edge, a side edge and a corner position of one or more corners of the sheet. After that, a calculation of one or more estimated sheet positions of the sheet coinciding with the portion of the sheet at the monitoring sensor based on the sheet velocity, the first position of the sheet, the second position of the sheet, and the angular orientation of the sheet is performed in step 30. Finally, step 32 updates the one or more estimated sheet positions based on the comparison of each of the one or more reference points collected by the monitoring sensor to the one or more estimated sheet positions corresponding to the one or more reference points.

The method 20 may use the controller 16 to determine the sheet velocity, as in step 26, and to calculate the one or more estimated sheet positions, as in step 30. The controller 16 may also send error signals to the exposure device 8, such that the position and orientation of the sheet may be updated and/or adjusted according to the comparison of the one or more reference points collected by the monitoring sensor and the corresponding one or more estimate sheet positions, as in step 32. Alternatively, the exposure device 8 may adjust the positioning of the photoreceptor 10 to ensure proper printing of the image onto the sheet.

The method 20 described above uses a minimum of four sensors. Additionally, if more sensors are deployed, their signals may be used to further update the estimation of the sheet position and orientation. For example, the above method 20 may be used to reduce errors due to slipping, run-outs, and other known events on the feed path 6. Frequency of execution will vary depending upon the cycle time of the specific controller 16 employed, but the best mode contemplated is a minimum of 1000 executions per second.

Figure 3:
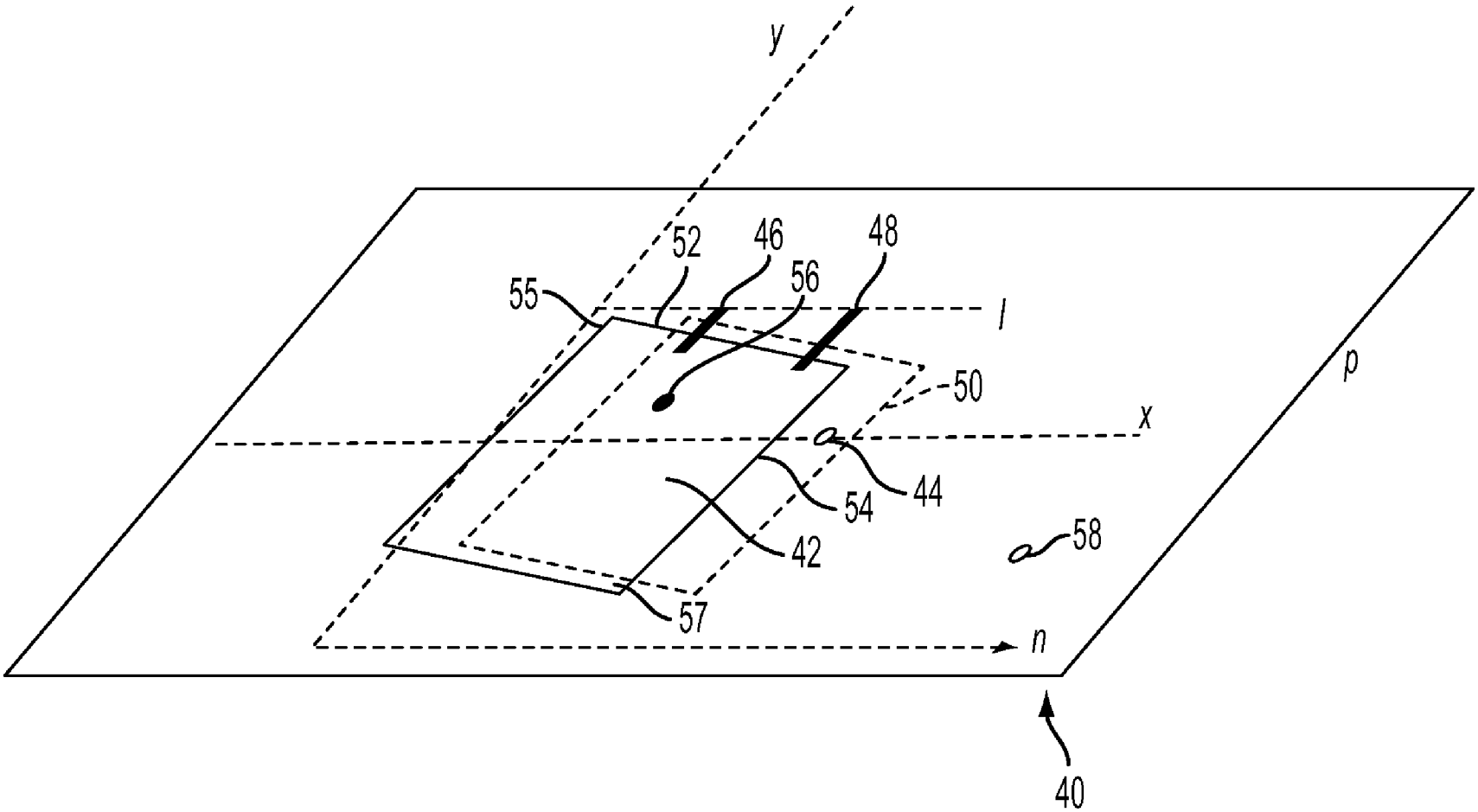
FIG. 3 illustrates a simplified isometric view of a skewed sheet on a feed path of a sheet observer system with two array sensors, one point sensor, and a monitoring sensor.
Figure 4:
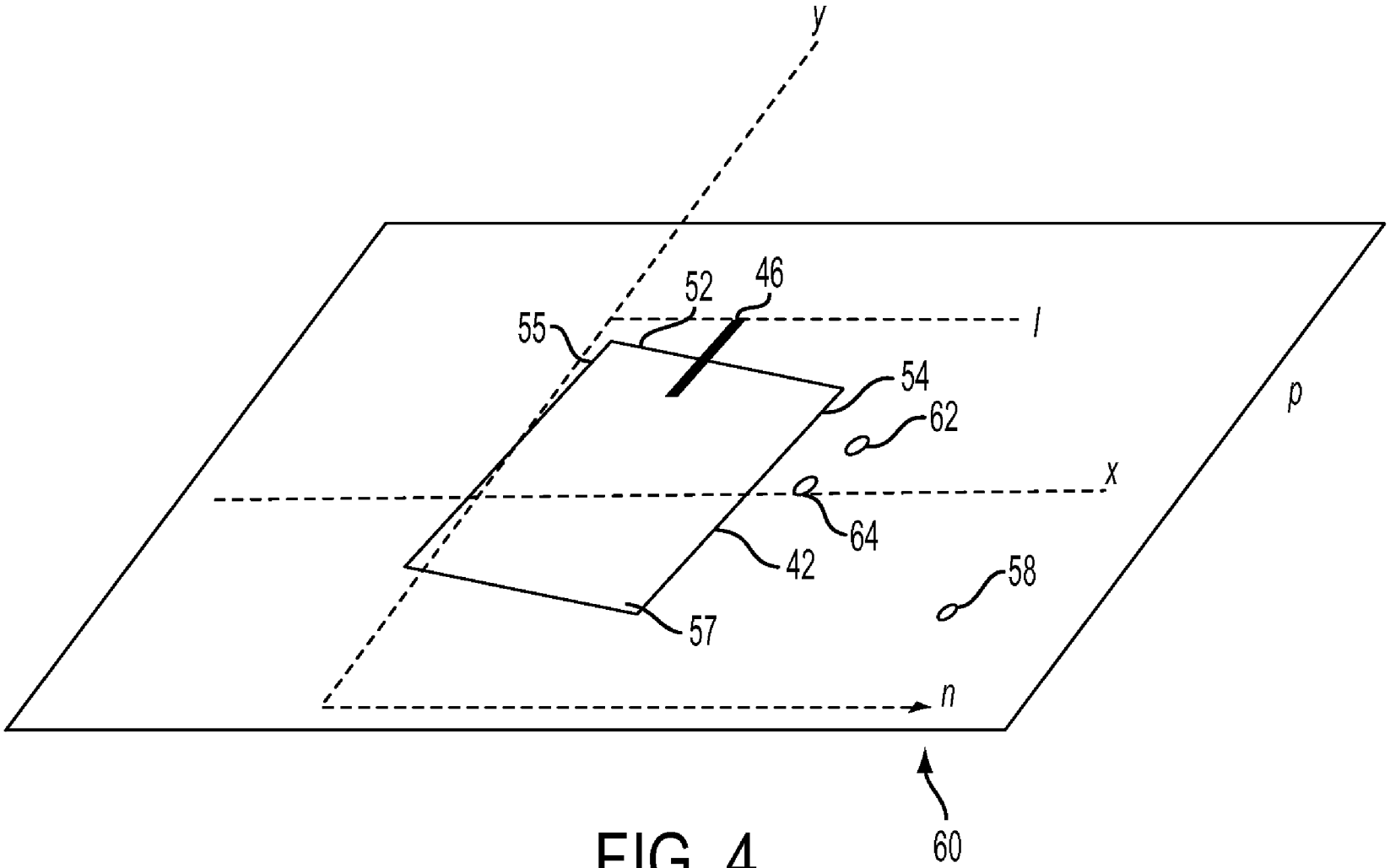
FIG. 4 illustrates a simplified isometric view of a skewed sheet on a feed path of a sheet observer system with one array sensor, two point sensors, and a monitoring sensor.
Figure 5:
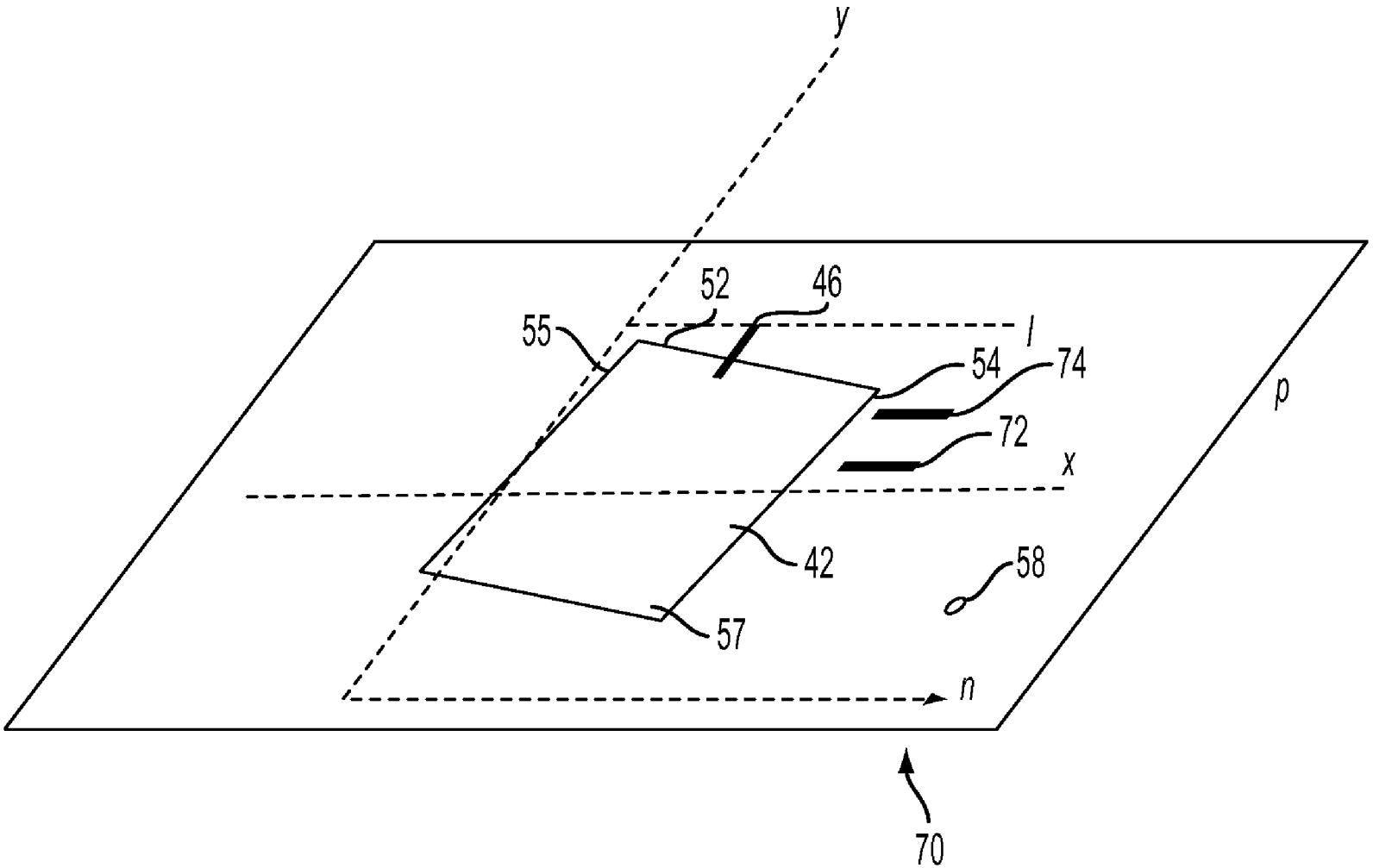
FIG. 5 illustrates a simplified isometric view of a skewed sheet on a feed path of a sheet observer system with three array sensors and a monitoring sensor.

Referring now to FIGS. 3-5, exemplary sheet observer systems 40, 60, 70 for use with the method 20 of FIG. 2 are shown. The x axis (or first reference axis) represents a process direction at the longitudinal mid point (not shown) of the feed path 6. The x axis lies in a reference plane p. The y axis (or transverse axis) represents a direction perpendicular to the x axis and represents the cross-process or lateral direction of a sheet 42. In a given sheet observer system 4, the direction of process may be either left-to-right or right-to-left along with respect to the x axis. Line l is parallel to the x axis and depicts the nominal position of the top edge baffle. Line n is also parallel to the x axis and depicts the nominal position of the bottom edge baffle. In this illustration the direction of process is shown by line n as being left-to-right.

FIGS. 3-5 further provide an illustration of the sheet 42 with an exaggerated skew. The skew (or angular orientation) is the angle of deviation of a top edge 52 from the line l parallel to the x axis. In a perfect hypothetical feed path on the x axis conveying a perfectly rectangular sheet 42, the lead edge 54 and the trail edge 55 would be parallel to they axis and the angle of deviation would be zero degrees. With such a hypothetical device and the sheet 42, the lead edge 54 would always remain parallel to the y axis at all points along the x axis as the sheet 42 travels along the feed path 6.

The exemplary sheet observer systems 40, 60, 70 provided below use various sensor configurations to capture measurement information as a sheet 42 moves along the x axis. The sensors are configured such that at least one point sensor is disposed in the feed path 6 at a point between a top edge and a bottom edge baffle and at least one linear array sensor is disposed on line l. The point sensor may be configured to sense the lead edge 54 and/or the trail edge 55 of the sheet 42. The at least one linear array sensor is disposed parallel to line l.

With reference to FIG. 3, a sheet sensor system 40 is provided with the at least one point sensor including one point sensor 44 and the at least one linear array sensor including two linear array sensors 46, 48. The point sensor 44 and linear array sensors 46, 48 are fixed references that register sheet information as the sheet 42 moves past the respective sensors.

The coordinates of sensors 44, 46, and 48 may be expressed as follows:

| | |
|---|---|
| location of point sensor 44: | (x1, y1); |
| location of linear array sensor 46: | (x2, y21:y22); |
| location of linear array sensor 48: | (x3, y31:y32). |

According to the exemplary system 40 and the sheet position and orientation shown, the projection lines 50 indicate the position of the sheet 42 after moving approximately 50 milliseconds along the feed path 6 (or x axis).

In operation, as the sheet 42 moves along the feed path 6, the lead edge 54 of the sheet 42 triggers the point sensor 44, which determines a first position (or process position) with reference to the x axis. Then, the array sensors 46, 48 may be used to determine a second position (or the lateral position) with reference to the top edge 52 of the sheet 42 with respect to the x axis. For example, the lateral position of the sheet 42 may be determined by finding the average of they axis values collected by the array sensors 46 and 48. The array sensors 46, 48 are then used to determine an angular orientation (or a skew) by calculating the difference between the y values collected by the linear array sensors 46, 48.

The system 40 then uses the process position, the lateral position, and the skew of the sheet 42 and information regarding the location of the sensors 44, 46, 48 to compute the complete position and orientation of the sheet 42 at that instant of time. Further, if the dimensions and squareness of the sheet 42 are known, it is also possible to determine the position of each corner and a center of mass 56 of the sheet 42.

According to a first sheet observer system 40 of FIG. 3 and the above method 20, the orientation of the sheet 42 may be expressed as ($x_{cm}$, $y_{cm}$, $\theta_{cm}$) at the center of mass 56 of the sheet 42, where:

| | |
|---|---|
| $x_{cm}$: | x axis coordinate or position of the CM 56; |
| $y_{cm}$: | y axis coordinate or position of the CM 56; |
| $\theta_{cm}$: | angular orientation of the sheet 42 at CM 56. |

Using a registration device in the first sheet observer system 40, the velocity vectors ($v_x$, $v_y$, $\omega$) of the sheet center of mass 56 may then be determined depending upon the sheet velocity at two contact points of the sheet 42 where:

$v_A$—inboard contact point velocity, $R^3$ vector;

$v_B$—outboard contact point velocity, $R^3$ vector;

$r_A$—inboard contact point position, $R^3$ vector;

$r_B$—outboard contact point position, $R^3$ vector.

The equations utilized to compute the two velocity vectors $v_A$ and $v_B$ depend on the type of registration and kinematics of the specific sheet observer system 4.

For example, the printmaking device may use the Transactional Electronic Registration (TELER) sheet registration device, in which case the velocity vectors $v_A$ and $v_B$ are computed as follows:

$$v_A = v_{Ax} e_x + \dot{y} e_y,$$

$$v_B = v_{Bx} e_x + \dot{y} e_y,$$

where $v_{Ax}$ is the inboard contact point surface velocity magnitude, $V_{Bx}$ is the outboard contact point surface velocity magnitude, and $\dot{y}$ is the TELER carriage lateral velocity. A further example of velocity vectors is shown with the Agile Nip sheet registration device of the printmaking device, where the velocity vectors $v_A$ and $v_B$ are determined by:

$$v_A = v_{Ax} e_x,$$

$$v_B = v_{Bx} e_x.$$

After the contact point velocities and contact point positions are determined for a respective printmaking device, the sheet velocities are given by the following kinematical relationships:

$$v = \frac{1}{2}[v_A + v_B - \omega \times (r - r_A + r - r_B)],$$

$$\omega = \frac{v_{Ax} - v_{Bx}}{D_y},$$

where $D_y$ is the distance between a first contact point A and a second contact point B along the y axis. In the above equations, v is the velocity of the center of mass 56 for the $R^3$ vector and $\omega$ is the angular velocity of the center of mass 56 in the direction of line n. After calculating the sheet center of mass velocities (v, $\omega$), it is possible to estimate the future position and orientation of the center of mass 56. Then, the future position and orientation (r, $\theta$) of the center of mass 56 of the sheet 42 can be estimated at time t using:

$$r = r_{cm} + \int v \, dt,$$

$$\theta = \theta_{cm} \int \omega \, dt.$$

Assuming that the dimensions and squareness of the sheet 42 is known, the position and orientation (r, $\theta$) of the lead edge 54 and/or the trail edge 55 or any of the corners of the sheet 42 may be determined. If dimensions and/or squareness of the sheets 42 are not perfectly known, then the angular orientation, lateral position, and process position are best known for the edges for which sensing was performed and estimated for the remaining edges.

Using the estimated position and orientation (r,$\theta$) of the lead edge 54 and/or trail edge 55 or any of the corners of the sheet 42 and at least one monitoring sensor, the sheet sensor system 40 may monitor the sheet 42 using a limited number of sensors. The at least one monitoring sensor may capture measurement information of one or more reference points corresponding to the at least one monitoring sensor and then calculate one or more estimated sheet positions coinciding with the portion of the sheet 42 at the monitoring sensor. The sheet position and orientation is then updated by comparing each of the one or more reference points collected by the at least one monitoring sensor to the one or more estimated sheet positions corresponding to the one or more reference points.

The at least one monitoring sensor may be configured such that a monitoring sensor 58 is disposed in the feed path 6 at a point between a top edge and a bottom edge baffle. The one or more reference points of the sheet 42 correspond to the location of the monitoring sensor 58 as the sheet 42 continues to move along the feed path 6. The one or more reference points may be one or more of the following selected from the group consisting of the lead edge 54, the trail edge 55, and a corner position of the one or more corners of the sheet 42.

For example, the monitoring sensor 58 of FIG. 3 may be used with the method 20 provided herein. First, the system 40 determines a position and orientation of the sheet 42 using one point sensor 44 and two array sensors 46, 48. Next, the controller 16 determines the contact point velocities and contact point positions for the printmaking device. After that, the sheet 42 continues to move along the feed path 6 and past a monitoring sensor 58, which in FIG. 3 measures a bottom corner 57 of the lead edge 54 of the sheet 42. Then, the controller 16 calculates an estimated sheet position coinciding with the bottom corner 57 of the lead edge 54 of the sheet 42 and the controller 16 compares the estimated sheet position of the bottom corner 57 and the bottom corner 57 of the lead edge 54 measurement collected by the monitoring sensor 58. Finally, the estimated sheet position is updated based on the comparison.

Referring now to FIGS. 4 and 5, a second and a third sheet observer system 60 and 70 containing variations of the sensor configuration are shown. FIG. 4 illustrates the second sheet observer system 60 two point sensors 62, 64 to detect the lead edge 54, one linear array sensor 46 disposed at line l, and one monitoring sensor 58. A first point sensor 62 is disposed on the x axis and a second point sensor 64 is located between line l and the x axis. The second point sensor 64 is aligned with the first point sensor 62, such that a line between the first and second point sensors 62, 64 is perpendicular to the x axis.

FIG. 5 illustrates the third sheet observer system 70 with a sensor configuration similar to FIGS. 4. FIG. 5 contains the linear array sensor 76 disposed at line l and the linear array sensors 72, 74, which replace the point sensors 62, 64 of FIG. 4 at the same relative positions. As shown in FIGS. 3-4, FIG. 5 also includes the monitoring sensor 58.

For the above sheet observer systems 40, 60, 70, the determination of process direction and skew may vary depending on the sensor types. For example, the linear array sensors 46, 48, 72, 74 may determine the process direction and skew using simultaneous readings of the sensors. While, the point sensors 44, 62, 64 require both the sensor readings and the sheet velocity information to determine the skew.

Use of the above method 20 with the systems 40, 60, 70 described herein produces better results when basic information about the sheet 42 is known. The information required may include the squareness of the sheet 42 and/or the dimensions of the sheet 42. Such information regarding the sheet 42 may be manually inputted by a user or automatically determined by the printmaking device. Furthermore, for higher accuracy actual sheet velocity should be used for integration in the above equations. The sheet velocity may be determined by any known sensing strategies, examples include mouse sensing or Encoded Skew and Process (ESP) sensing using encoders on idlers to determine the sheet velocity.

However, it will be appreciated that application of the method 20 could be extended to estimate the parameters of various sub-spaces in the $R^3$ space of $(x, y, \theta)$ when the initial state of sheet 42 is either unknown or only partially known. Those estimates can be used to correct for certain errors. By way of illustration, the method 20 or the systems 40, 60, 70 may be configured to arbitrarily assign initial conditions, such as the desired sheet location and orientation $(x_{cm}, y_{cm}, \theta_{cm})$ at a given time. The method 20 may then continue to estimate the position and/or orientation of the sheet 42, and commence updating the information regarding the sheet 42 as and when such information becomes available. For example, if only the lead edge 54 skew error information is available to start, the method 20 can be configured to make the assumption that the lateral and the process errors are zero. The method 20 may then estimate the position and orientation using the arbitrarily assigned initial values. As and when the lateral and the process information becomes available, the parameters may be updated, since skew correction can still be performed even before the method 20 corrects the process and lateral information.

It will be appreciated that this method 20 can be used to continuously estimate sheet position using three degrees of freedom (DOF) between points in time when sensors can detect all three degrees of freedom for the sheet 42. The three degrees of freedom in the method 20 herein described include: (1) surging forward or backward along the feed path 6 (process direction), (2) swaying left or right (lateral direction), and (3) tilting relative to the square (skew). The method 20 further provides for an improved and easier implementation of controls, such as continuous closed loop control, and provides for future updates from additional sensors, which can improve performance.

A further benefit is a reduction in the cost of the printmaking device because the systems 40, 60, 70 described herein require a fewer number of sensors for printing tasks. For example, current printmaking devices require several sensors for different sized sheets 42 and for duplex printing, but the systems 40, 60, 70 provided herein enable the use of one monitoring sensor 58 to replace the several sensors previously required.

It will be appreciated that variations of the above-disclosed and other features and functions, or alternative thereof, may be desirably combined into many other different systems or applications. Various presently unforeseen or unanticipated alternatives, modifications, variations, or improvements therein may subsequently be made by those skilled in the art, which are also intended to be encompassed by the following claims. In addition, the claims can encompass embodiments in hardware, software, or a combination thereof.

What is claimed is:

1. A method for determining sheet position and orientation of a sheet as the sheet moves along a feed path comprising:

moving the sheet along the feed path and past at least one point sensor to measure a first position of the sheet relative to a first reference axis coinciding with a process direction of the feed path, said first position being determined within a reference plane through which said first reference axis passes;

moving the sheet along the feed path and past at least one linear array sensor to measure a second position of the sheet relative to a second reference axis disposed perpendicular to said first reference axis and to measure an angular orientation of the sheet in said reference plane relative to a third reference axis perpendicular to said reference plane, said second position of the sheet being determined as a distance of a side edge of the sheet from said first reference axis and said angular orientation of the sheet being determined about said third reference axis disposed perpendicular to said reference plane;

determining with a controller a sheet velocity;

determining with said controller at least one estimated sheet position along the feed path using said sheet velocity, said first position of the sheet, said second position of the sheet, and said angular orientation of the sheet;

moving the sheet along the feed path and past at least one monitoring sensor, said at least one monitoring sensor detecting at least one reference point of the sheet, said at least one reference point being at least one of the following selected from the group consisting of a lead edge, a trail edge, a side edge, and a corner position of at least one corner of the sheet;

comparing with said controller said at least one estimated sheet position of the sheet and said at least one reference point; and updating the determination of said at least one estimated sheet position based on the comparison between said at least one estimated sheet position and said at least one reference point.

2. The method of claim 1, wherein, said sheet velocity may be determined by at least one of the methods including: input received from said controller, a speed of the feed path along which the paper moves, and measuring said sheet velocity directly using at least one velocity sensor.

3. The method of claim 1, further comprising the step of providing a set of known variables to a printmaking device, said set of known variables including a set of dimensions of the sheet, a squareness of the sheet, and a location of all sensors.

4. The method of claim 3, wherein said known variables are manually entered by the user.

5. The method of claim 3, wherein said known variables are determined by said printmaking device.

* * * * *